US006658913B1

(12) United States Patent
Zanzerl et al.

(10) Patent No.: US 6,658,913 B1
(45) Date of Patent: Dec. 9, 2003

(54) MULTISTAGE METAL-FORMING MACHINE TOOL HAVING TOOL COMBINATION BLOCKS

(75) Inventors: Hermann Zanzerl, Olsberg (CH); Markus Moser, Münchenstein (CH)

(73) Assignee: Hatebur Umformmaschinen AG (CH)

( * ) Notice: Subject to any disclaimer, the term of this patent is extended or adjusted under 35 U.S.C. 154(b) by 0 days.

(21) Appl. No.: 09/647,694

(22) PCT Filed: Mar. 22, 1999

(86) PCT No.: PCT/CH99/00123

§ 371 (c)(1),
(2), (4) Date: Oct. 2, 2000

(87) PCT Pub. No.: WO99/54071

PCT Pub. Date: Oct. 28, 1999

(30) Foreign Application Priority Data

Apr. 17, 1998 (CH) ..... 884/98

(51) Int. Cl.[7] ..... B21J 13/03; B21J 13/08

(52) U.S. Cl. ..... 72/482.2; 72/481.1; 72/481.6; 72/405.12

(58) Field of Search ..... 72/482.2, 482.3, 72/482.93, 481.1, 481.6, 405.12

(56) References Cited

U.S. PATENT DOCUMENTS 3,559,446 A 2/1971 Dom et al.
3,802,013 A * 4/1974 Nebendorf et al. ..... 470/141
4,898,017 A * 2/1990 Hite et al. ..... 72/405.12
4,966,028 A * 10/1990 Sakamura et al. ..... 72/405.12
5,005,397 A * 4/1991 Hite et al. ..... 72/405.12
5,829,302 A 11/1998 Hite
5,848,547 A 12/1998 Hite

FOREIGN PATENT DOCUMENTS

| | | |
|---|---|---|
| DE | 1149970 | 6/1963 |
| DE | 19722228 | 12/1997 |
| EP | 0354428 | 2/1990 |

OTHER PUBLICATIONS

"Der Neue Formmaster FM" Umformtechnik, vol. 31, No. 2, Jun. 1997, p. 16/17 XP000692588.

* cited by examiner

*Primary Examiner*—David B. Jones
(74) *Attorney, Agent, or Firm*—McCarter & English, LLP

(57) ABSTRACT

In a multistage forming machine, an apron is screwed to a press slide. At its upper end, the apron has six elongated clamping cams, distributed over its width, while four upwardly projecting clamping lugs are fitted at is lower end. Suspended in the apron is a combined tool block with a wedge-shaped supporting plate. Four clamping lugs, distributed over the width, are formed at the upper end of the supporting plate, while four clamping cams are formed at the lower end. The clamping lugs of the combined tool block are suspended by means of the clamping cams of the apron, while the clamping cams of the combined tool block are inserted between the clamping lugs and the main part of the apron. By means of two clamping devices, a clamping force acting in the vertical direction of the combined tool block is produced, bringing about a clamping of the combine tool block and the press slide in the horizontal direction.

19 Claims, 6 Drawing Sheets

MULTISTAGE METAL-FORMING MACHINE TOOL HAVING TOOL COMBINATION BLOCKS

FIELD OF THE INVENTION

The present invention relates to a multi-stage forming machine with combined tool blocks.

BACKGROUND OF THE INVENTION

In conventional multi-stage forming machines, the removal, fastening and setting of tools requires the loosening or screwing in of screws, so that a tool change normally takes around an hour or more. Since the forming machine is out of operation during this time, this entails a considerable loss in productivity. Therefore, forming machines which allow a faster tool change have been developed.

DE-A-197 22 228 discloses a multi-stage forming machine in which each tool is arranged in a tool cartridge which is held in the forming machine by means of a clamping device. The securely clamped tool cartridges can be exchanged relatively quickly as and when required, so that the downtime of the forming machine can be reduced considerably. However, a tool change still takes a comparatively long time, since the fine setting of the distance between two opposite interacting tools is performed on the forming machine.

EP-B-0 354 428 describes a multi-stage forming machine which comprises a first combined tool block, with for example five female-die blocks, fitted on a fixed machine body, and a second combined tool block, with for example five male-die blocks, fitted on a press slide which can be moved back and forth in the direction of the said first combined tool block. The combined tool blocks are exchangeable as a whole and can be set outside the forming machine. To obtain adequate clamping, the combined tool blocks are screwed to the machine body or press slide. This has the disadvantage that quick changing of combined tool blocks is not possible, since the operating personnel have to work from the outside using auxiliary tools.

In view of the disadvantages of the previously known forming machines described above, the invention is based on the following object. It is intended to provide a multi-stage forming machine of the type mentioned at the beginning in which the downtime of the forming machine when changing tools can be reduced considerably with respect to comparable forming machines of the prior art.

SUMMARY OF THE INVENTION

The essence of the invention is that a multi-stage forming machine comprises a first and second combined tool block, of which at least one has at least one clamping lug, by which it is suspended, by means of a clamping cam fitted directly or indirectly on a fixed machine body or on a press slide, directly or indirectly from above on the machine body or on the press slide. The clamping lug and the clamping cam are designed in such a way that the dead weight of the combined tool block and/or a clamping force acting in the vertical direction on the combined tool block produces a resilient clamping together of the combined tool block and the machine body or press slide in the horizontal direction. The first and second combined tool blocks have interacting individual tool blocks and are respectively fitted on the fixed machine body and the press slide, which can be moved back and forth in the direction of the first combined tool block.

The suspending of the combined tool block by clamping lugs directly or indirectly on the machine body or on the press slide makes it possible for the combined tool block to be fitted and removed quickly, since it is possible to dispense with screwing. The necessary clamping of the combined tool block to the machine body or press slide is produced by the clamping lug and the clamping cam, which partially deflect the dead weight of the combined tool block and/or a clamping force acting in the vertical direction on the combined tool block into a horizontal clamping force. The clamping has the effect of prestressing the clamping lug in such a way that it is additionally loaded only insignificantly by production-related forces on the combined tool block, as a result of which it is fatigue-resistant. Any clamping device can be arranged outside the tool space, so that it does not take up any space in the latter. The exchanging of an entire combined tool block allows the fine setting of the distance between two opposite interacting individual tool blocks outside the forming machine, while the latter can continue to be operated with the old combined tool block. The downtime can in this way be restricted to the removal of the old combined tool block and the actual fitting of the new combined tool block.

Normally, both combined tool blocks are provided with at least one clamping lug and are suspended directly or indirectly on the machine body or press slide, but it is also conceivable in principle for one of the combined tool blocks to be fastened in some other way.

In a first advantageous design variant, the said at least one clamping lug is arranged in the upper edge region of the combined tool block and at least one further clamping lug is arranged in the lower edge region of the combined tool block and is suspended by means of a further clamping cam from above directly or indirectly on the machine body or on the press slide.

In a second advantageous design variant, the said at least one clamping lug is arranged in the upper edge region of the combined tool block and at least one downwardly projecting clamping cam is arranged in the lower edge region of the combined tool block and is pushed into an upwardly open clamping lug fitted directly or indirectly on the machine body or on the press slide.

These two design variants make it possible for the combined tool block to be clamped uniformly at the top and bottom.

The clamping lug or lugs and/or the clamping cam or cams advantageously has or have a bearing face for the assigned clamping cam or clamping lug, which face is inclined with respect to the vertical and is preferably curved, so that when a vertically downwardly directed force is exerted on the combined tool block the clamping lug or lugs is or are bent outwards by the assigned clamping cam or cams. The resilient bending of the clamping lug or lugs allows a high prestressing to be produced in the horizontal direction, which provides a secure, clamped fastening of the combined tool block, counteracts the development of fretting corrosion and makes it unnecessary for the contact surfaces to fit one another absolutely exactly. The curving of the bearing face prevents edge pressure from occurring.

A plurality of clamping lugs are advantageously arranged in the upper edge region of at least one of the two combined tool blocks and/or a plurality of downwardly projecting clamping cams are advantageously arranged at intervals next to one another in the lower edge region of this combined tool block. As a result, the combined tool block can be supported and clamped over a wide area.

The combined tool block with clamping lugs or at least one of the combined tool blocks with clamping lugs advantageously has at least one stop which rests from above on a stopping face outside the combined tool block. The combined tool block is thus accurately positioned vertically during suspension and thereby defines the maximum clamping force.

BRIEF DESCRIPTION OF THE DRAWINGS

The multi-stage forming machine according to the invention is described in more detail below on the basis of an exemplary embodiment with reference to the attached drawings, in which.

DETAILED DESCRIPTION OF THE INVENTION

FIGS. 1 to 6—part of the forming machine on the female die side

Figure 4:
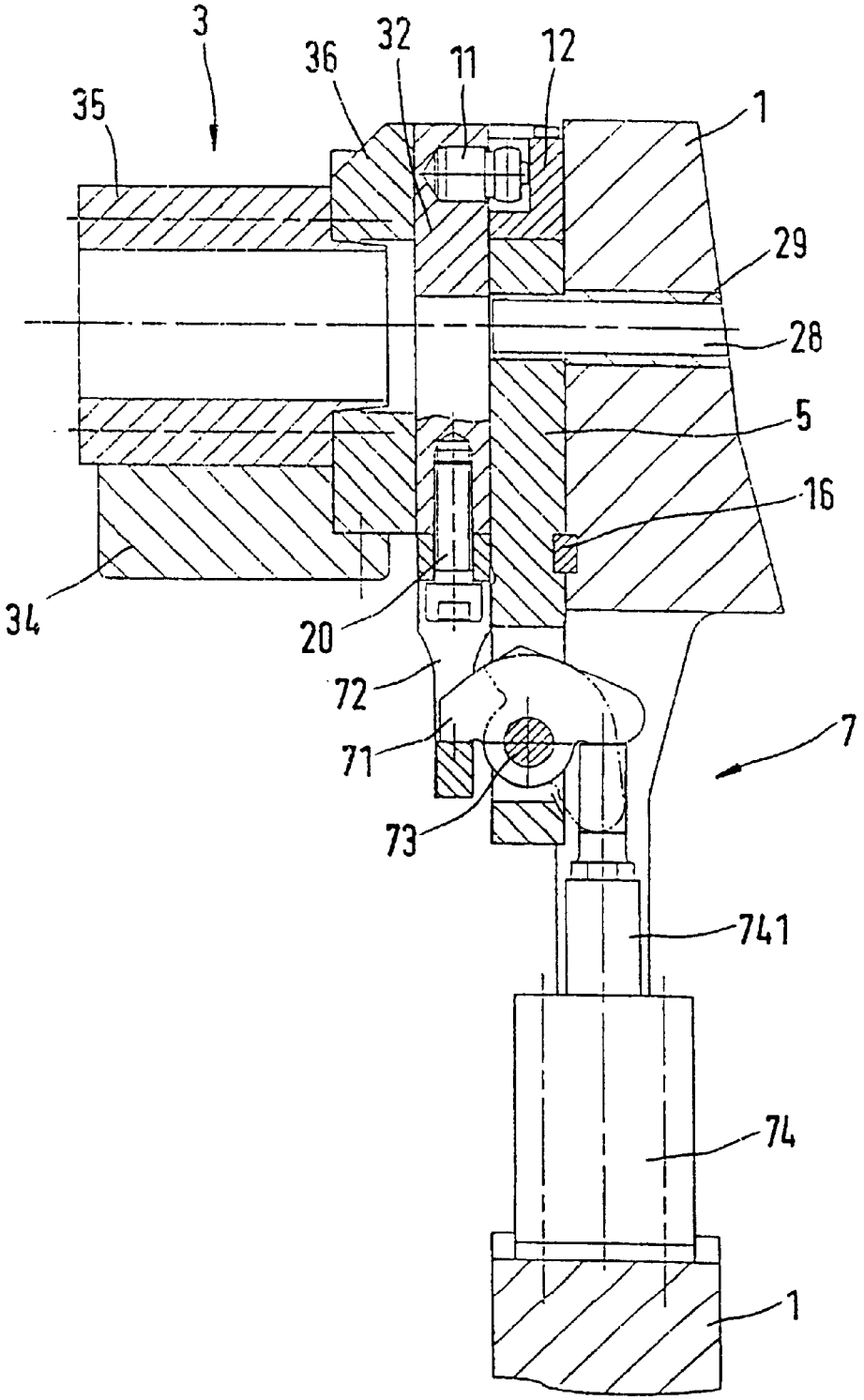
FIG. 4 shows part of the forming machine with a combined tool block and clamping device on the female die side, in a further vertical sectional view.

A multi-stage forming machine according to the invention comprises a machine body 1, to which an apron 5 is fastened by means of screws 15. Force-absorbing wedges 16 (FIG. 4), arranged in wedge-shaped recesses 53 (FIG. 5) in the apron 5 serve in addition to the screws 15 for supporting the vertical clamping forces occurring. Running through the machine body 1 and the apron 5 are an ejector-rod bore 28 and an ejector-rod guide 29 (FIG. 4). At its upper end, the apron 5 has two elongated clamping cams 52, which extend on either side of a centring housing 12, arranged above the apron 5, respectively up to the lateral edge of the said apron. At the lower end of the apron 5, four upwardly projecting clamping lugs 51 are fitted, distributed over its width.

Figure 6:
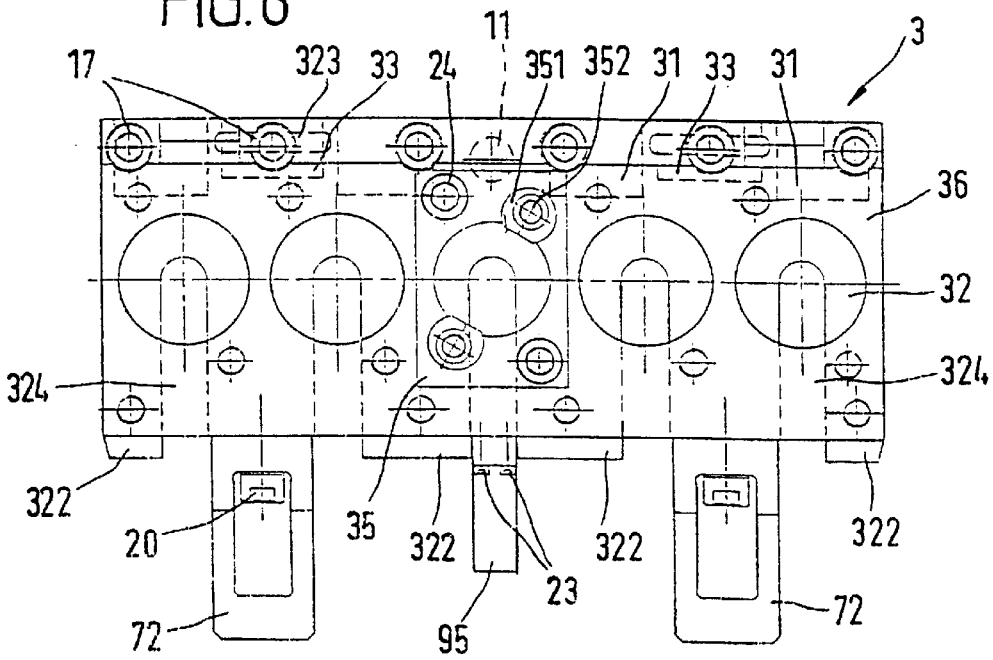
FIG. 6 shows the removed combined tool block on the female die side of the forming machine.

Suspended in the apron 5 is a combined tool block 3, with a supporting plate 32, a centring plate 36, normally five female-die blocks 35 and a block guide 34 extending over the entire width. Drawn in FIG. 6 is a female-die block 35, which is fastened to the centring plate 36 by means of screws 24. The clamping of the female die takes place by means of claws 351 and claw screws 352. The block guide 34, centring plate 36 and supporting plate 32 are connected to one another by means of screws 18 and the centring plate 36 and supporting plate 32 are additionally connected to each other by means of screws 17. Four clamping lugs 31 are formed at the upper end of the supporting plate 32, evenly distributed over the width, while four clamping cams 322 are formed at the lower end. Fastened by means of screws 19 to the supporting plate 32 respectively between the two outer clamping lugs 31 are stops 33, which rest on stopping faces 521 on the clamping cams 52 of the apron 5 and thus accurately position the combined tool block 3 vertically. Force-absorbing wedges 316 (FIGS. 2 and 3), arranged in wedge-shaped recesses 323 (FIG. 6) in the supporting plate 32, serve in addition to the screws 19 for supporting the clamping forces occurring. The supporting plate 32 has, furthermore, slot-shaped recesses 324, which make it possible for the combined tool block 3 to be inserted and lifted out, whilst ejector rods protrude into the region of the supporting plate 32.

Figure 5:
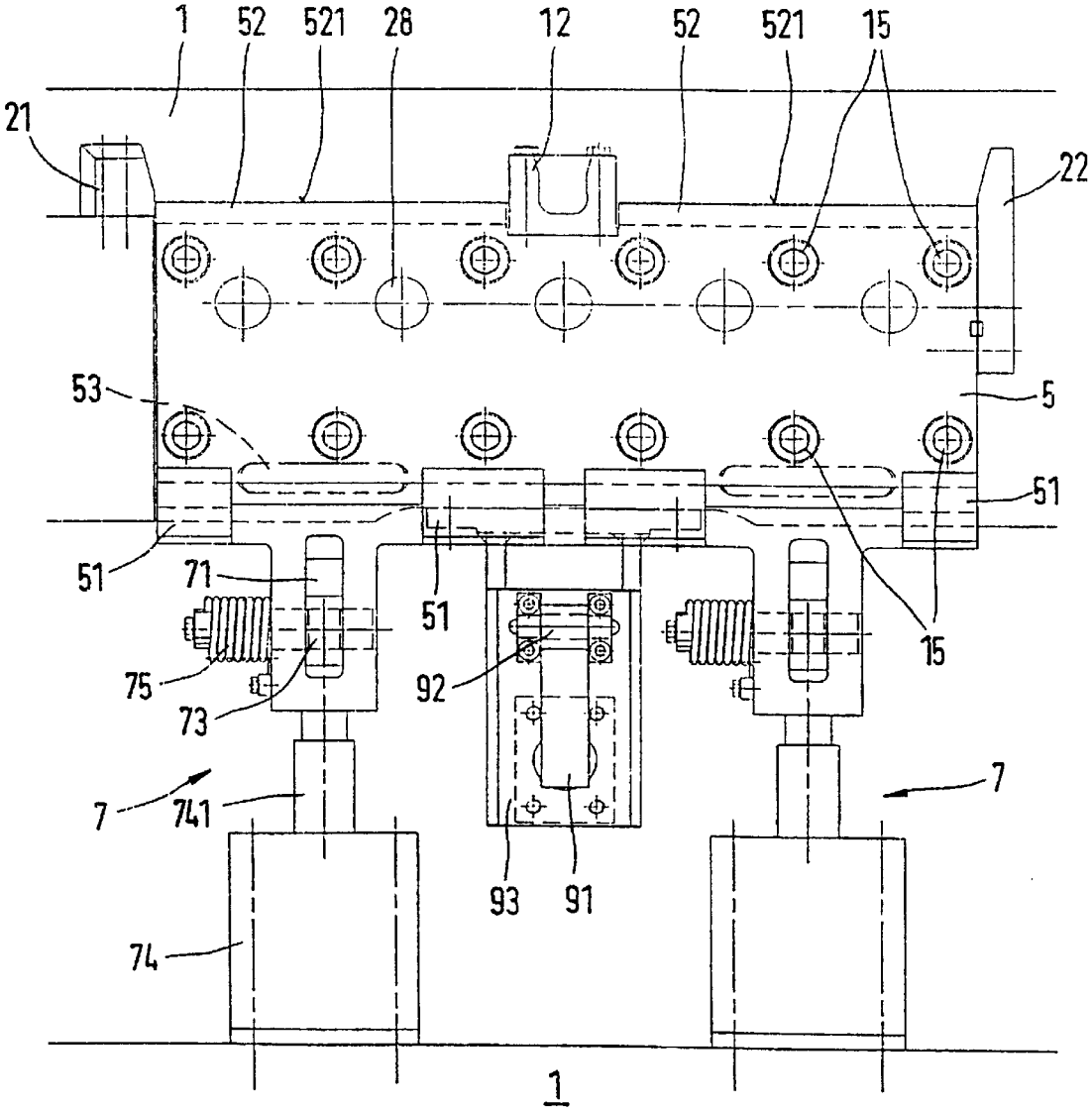
FIG. 5 shows the part of the forming machine on the female die side with the combined tool block removed, seen from the male die side.

For the horizontal centring of the combined tool block 3, a centring pin 11 with a spherical head is screwed into the supporting plate 32 (FIG. 4). During the suspension of the combined tool block 3, the spherical head is inserted into the centring housing 12 and directed into the desired horizontal position by the special design of the said housing (FIG. 5).

Figure 1:
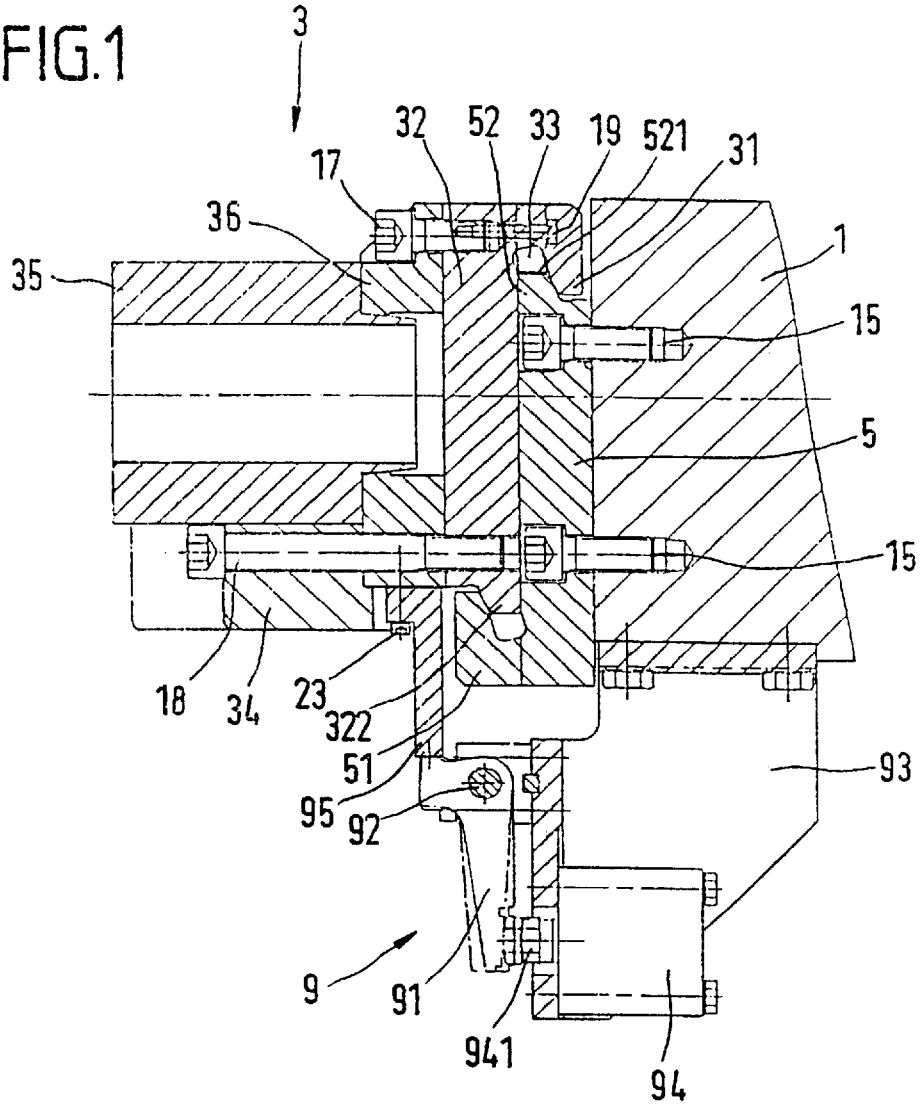
FIG. 1 shows part of a multi-stage forming machine according to the invention with a combined tool block and releasing device on the female die side, in a vertical sectional view.
Figure 2:
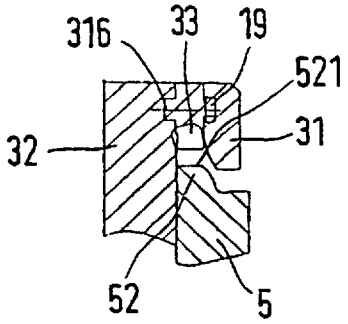
FIGS. 2 and 3 show detailed sectional views of a clamping lug, stop and clamping cam of the forming machine during suspension.
Figure 3:
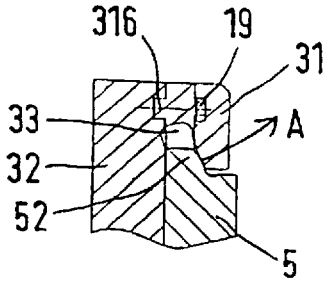

The suspension of the combined tool block 3 in the apron 5 generally takes place by means of an external crane device (not shown here) To make it easier for the combined tool block 3 to be fitted into the tool space, insertion aids 21, 22 are provided on the machine body 1 and on the apron 5. The clamping lugs 31 of the combined tool block 3 are hung over the clamping cams 52 of the apron 5, while the clamping cams 322 of the combined tool block 3 are inserted between the clamping lugs 51 and the vertical bearing face of the apron 5 and the spherical head of the centring pin 11 is inserted into the centring housing 12. Thus, the dead weight of the combined tool block 3 is used to achieve a position in which the stops 33 are not yet resting on the stopping faces 521 of the clamping cams 52, but the clamping lugs 31 have already been minimally bent resiliently outwards by the clamping cams 52 in the direction of the arrow A (FIG. 3). In a corresponding way, the clamping lugs 51 have also been minimally bent resiliently outwards by the clamping cams 322. The clamping lugs 31 and 51 are in this way prestressed and exert a horizontal clamping force, which clamps together the combined tool block 3 and the apron 5, and consequently indirectly the machine body 1.

Since the clamping brought about by the dead weight of the combined tool block 3 is generally not adequate, a clamping force acting in the vertical direction on the combined tool block 3 is produced by two clamping devices 7 arranged underneath the combined tool block 3 (FIGS. 4, 5), by means of which force the clamping lugs 31 and 51 are further bent resiliently outwards and the clamping is increased to the desired degree. The clamping devices 7 each comprise a clamping lever 71, which can be pivoted about a clamping lever spindle 73 mounted on the apron 5. The clamping levers 71 can be actuated by means of hydraulic cylinders 74 with rams 741 and, when actuated, press down clamping clips 72 fastened by means of screws 20 to the supporting plate 32. The two extreme positions of a clamping lever 71 are drawn in FIG. 4. Bending springs 75 ensure that the clamping levers 71 are constantly in contact with the rams 741 of the double-acting hydraulic cylinders 74.

The clamping forces and clamping arrangements required vary according to the size of machine. With two clamping devices 7, material-dependent deformations of the clamping lugs 31, 51 in the range of tenths of a millimetre and a clamping force in the pressing direction of 250 kN were achieved with a vertical clamping force on the two clamping clips 72 of 110 kN in each case. In the case of smaller or larger forming machines, the clamping devices 7 were designed for clamping forces in the pressing direction of 125 kN and 500 kN, respectively.

For releasing the combined tool block 3, a releasing device 9 arranged thereunder is provided, the said device comprising a release lever 91, which can be pivoted about a release-lever spindle 92 and is mounted on a carriage 93 fastened to the machine body 1. The release lever 91 can be actuated by means of a hydraulic cylinder 94 with ram 941 and, when actuated, presses up a lifting element 95, fastened to the centring plate 36 by means of screws 23. The two extreme positions of the release lever 91 are drawn in FIG. 1.

FIGS. 7 to 10—part of the forming machine on the male die side

The fastening of a combined tool block 4 on the male die side to a press slide 2, which can be moved back and forth in the direction of the combined tool block 3 on the female die side, takes place in principle in the same way as the fastening of the combined tool block 3 on the female die side to the machine body 1.

An apron 6 is fastened to the press slide 2 by means of screws 115. At its upper end, the apron 6 has six elongated clamping cams 62, distributed over its width, while four upwardly projecting clamping lugs 61 are fitted at its lower end. The apron 6 has, furthermore, slot-shaped recesses 64, which make it possible for the combined tool block 4 to be inserted and lifted out, whilst ejector rods on the tool side protrude into the region of the apron 6.

Figure 10:
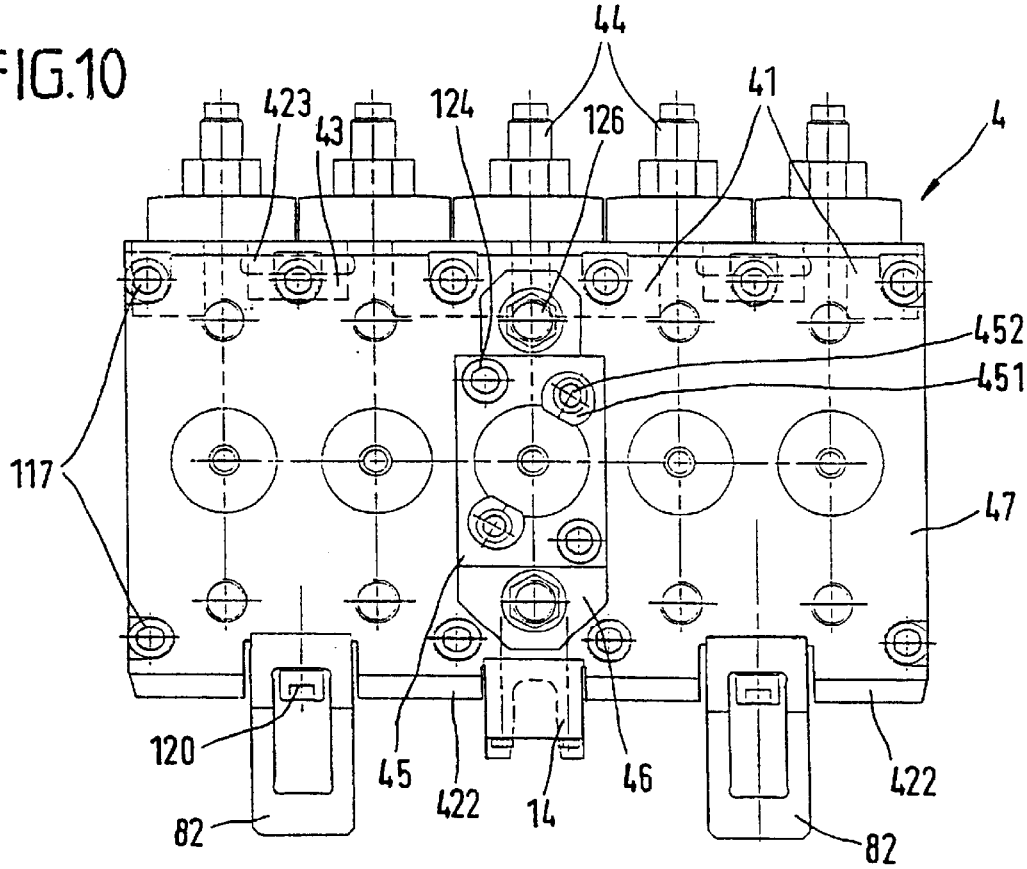
FIG. 10 shows the removed combined tool block on the male die side of the forming machine.

The combined tool block 4 is suspended in the apron 6 with a wedge-shaped supporting plate 42, five adjusting wedges 44, an adjusting-wedge housing 47 and normally five adjusting plates 46 and five male-die blocks 45. In FIG. 10 there is drawn only one male-die block 45, fastened to the associated adjusting plate 46 by means of screws 124. The clamping of the male dies takes place by means of claws 451 and claw screws 452. The adjusting plates 46 are fastened to the adjusting-wedge housing 47 by means of bolts 126 and nuts 127 screwed into the adjusting-wedge housing 47, the adjusting plates 46 having play around the bolts 126 before the nuts 127 are securely screwed, so that the said adjusting plates can be aligned with the female dies. The supporting plate 42 and the adjusting-wedge housing 47 are connected by means of screws 117.

Four clamping lugs 41 are formed at the upper end of the supporting plate 42, distributed over the width, while four clamping cams 422 are formed at the lower end, on either side of a centring housing 14 arranged underneath the supporting plate 42. Fastened by means of screws 25 to the supporting plate 42 respectively between the two outer clamping lugs 41 are stops 43, which rest on stopping faces 621 on the clamping cams 62 of the apron 6 and thus accurately position the combined tool block 4 vertically. Force-absorbing wedges 416, arranged in wedge-shaped recesses 423 (FIG. 10) in the supporting plate 42, serve in addition to the screws 25 for supporting the clamping forces occurring.

Figure 7:
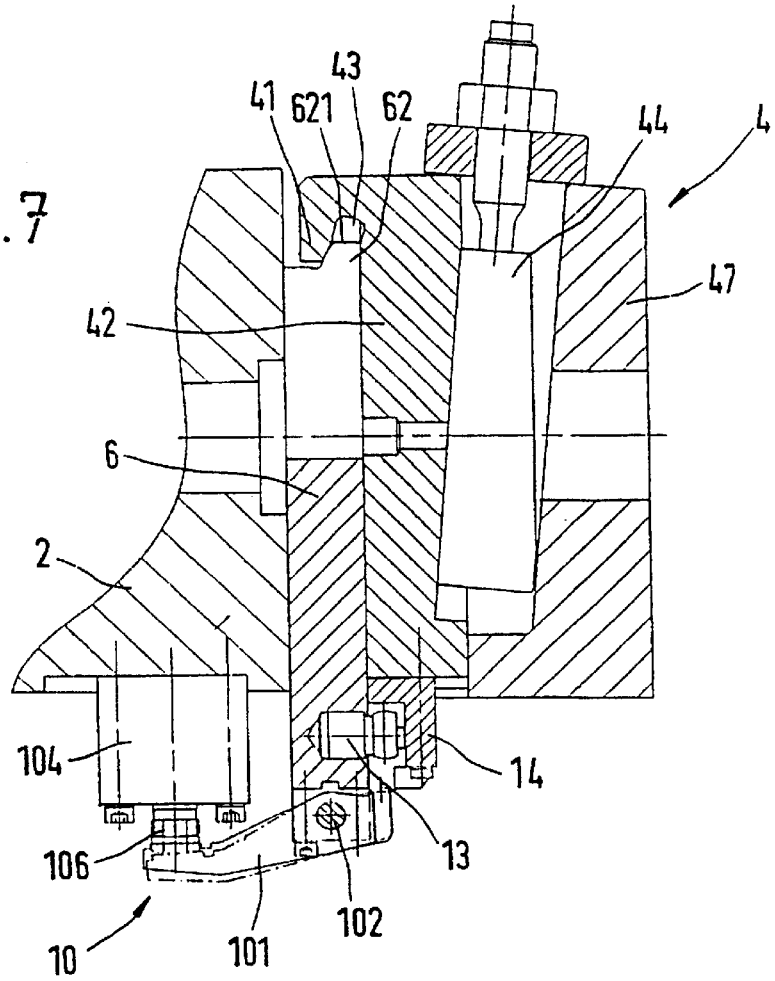
FIG. 7 shows part of the forming machine with a combined tool block and releasing device on the male die side, in a vertical sectional view.
Figure 8:
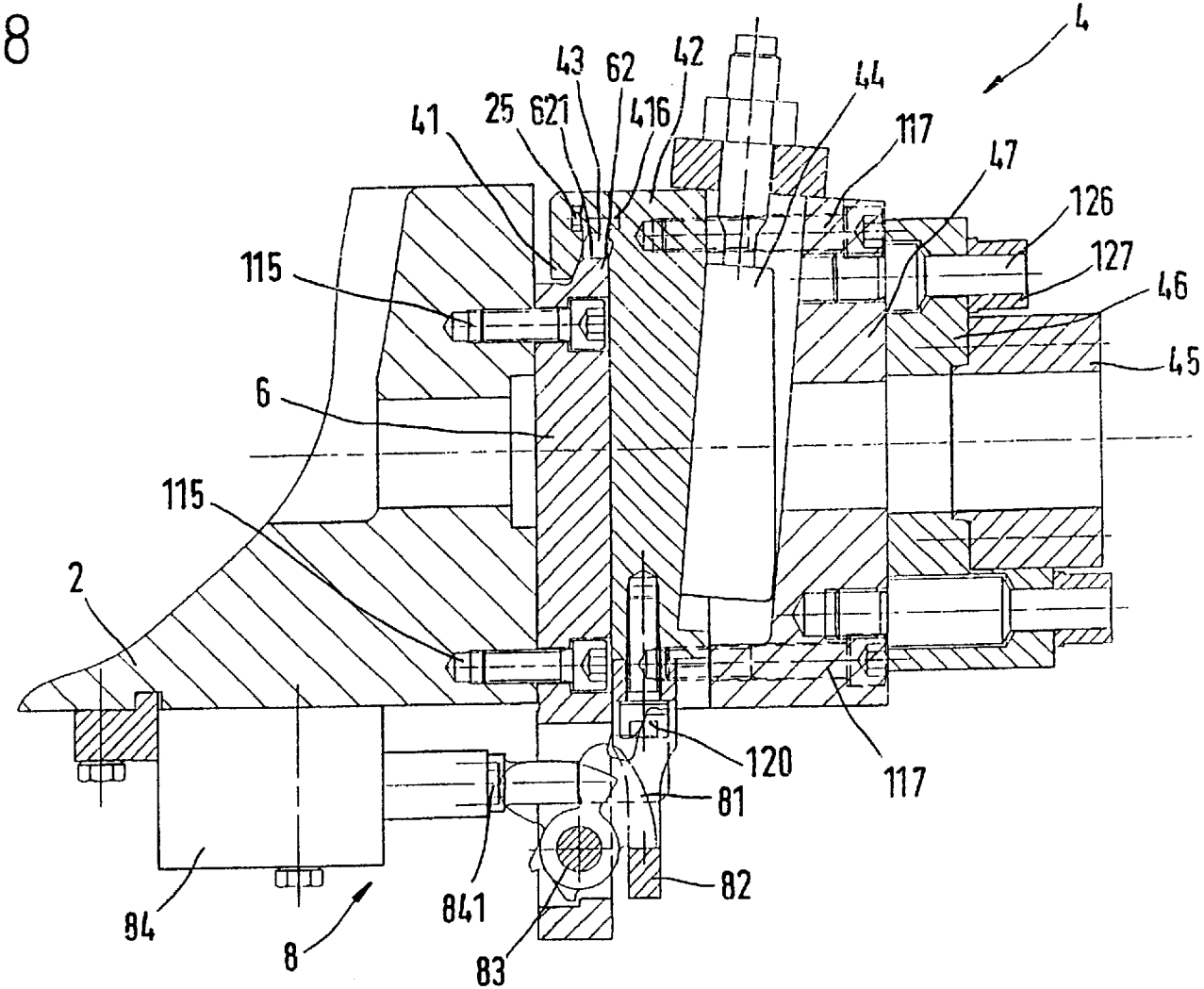
FIG. 8 shows part of the forming machine with a combined tool block and clamping device on the male die side, in a further vertical sectional view.
Figure 9:
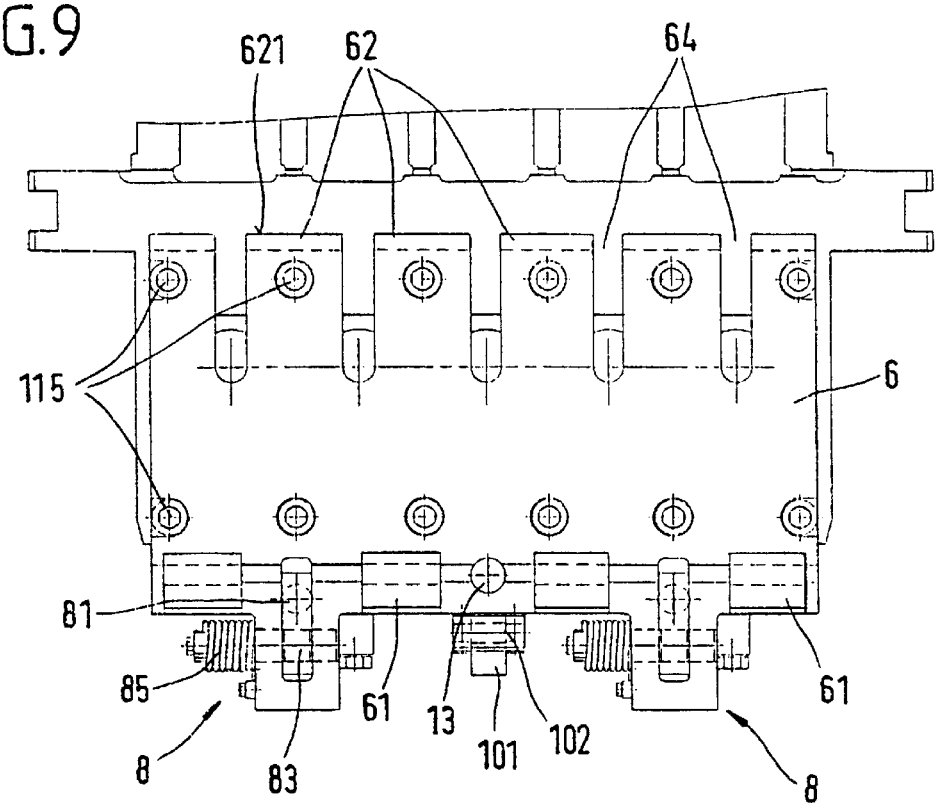
FIG. 9 shows the part of the forming machine on the male die side, with the combined tool block removed, seen from the female die side.

For the horizontal centring of the combined tool block 4, a centring pin 13 with a spherical head is screwed into the apron 6 (FIG. 7). During the suspension of the combined tool block 4, the centring housing 14 is guided by means of the spherical head and directed into the desired horizontal position.

The suspension of the combined tool block 4 in the apron 6 takes place again by means of an external crane device (not shown here). The clamping lugs 41 of the combined tool block 4 are hung over the clamping cams 62 of the apron 6, while the clamping cams 422 of the combined tool block 4 are inserted between the clamping lugs 61 and the vertical bearing face of the apron 6 and the centring housing 14 is guided by means of the spherical head of the centring pin 13. Thus, the dead weight of the combined tool block 4 is used to achieve a position in which the stops 43 are not yet resting on the stopping faces 621 of the clamping cams 62, but the clamping lugs 41 and/or 61 have aready been minimally bent resiliently outwards by the clamping cams 62 and 422, respectively. The clamping lugs 41 and 61 are in this way prestressed and exert a horizontal clamping force, which clamps together the combined tool block 4 and the apron 6, and consequently indirectly the press slide 2.

Since the clamping brought about by the dead weight of the combined tool block 4 is generally not adequate, a clamping force acting in the vertical direction on the combined tool block 4 is produced by two clamping devices 8 arranged underneath the combined tool block 4 (FIGS. 8, 9), by means of which force the clamping lugs 41 and 61 are further bent resiliently outwards and the clamping is increased to the desired degree. The clamping devices 8 each comprise a clamping lever 81, which can be pivoted about a clamping lever spindle 83 mounted on the apron 6. The clamping levers 81 can be actuated by means of hydraulic cylinders 84 with rams 841 and, when actuated, press down clamping clips 82 fastened by means of screws 120 to the supporting plate 42. The two extreme positions of a clamping lever 81 are drawn in FIG. 8. Bending springs 85 ensure that the clamping levers 81 are constantly in contact with the rams 841 of the double-acting hydraulic cylinders 84.

The clamping forces and clamping arrangements correspond approximately to those for the combined tool block 3 on the female die side.

For releasing the combined tool block 4, a releasing device 10 arranged thereunder is provided, the said device comprising a release lever 101, which can be pivoted about a release-lever spindle 102 and is mounted on the apron 6. The release lever 101 can be actuated by means of a hydraulic cylinder 104 with ram 106 and, when actuated, presses up the combined tool block 4 by means of the centring housing 14 arranged on the supporting plate 42. The two extreme positions of the release lever 101 are drawn in FIG. 7.

Further design variations of the parts described above of a forming machine can be realized. It should also be expressly mentioned here that there are many conceivable alternatives for the clamping and releasing mechanisms, such as toggle-lever, screw, cone or wedge clamping systems.

We claim:

1. Multi-stage forming machine comprising a first combined tool block fitted on a body which is a fixed machine body and a second combined tool block fitted on a body which is a press slide which can be moved back and forth relative to said first combined tool block, the first and second combined tool blocks each having individual tool blocks connected to a common supporting structure, the individual tool blocks of the first combined tool block interacting with the individual tool blocks of the second combined tool block, wherein at least one of said combined tool blocks has a clamping lug and the body corresponding to said at least one of said combined tool blocks has a clamping cam, said at least one of said combined tool blocks being suspended on said clamping cam, said clamping lug having a bearing face for said clamping cam and said clamping cam having a bearing face for said clamping lug, wherein at least one of the bearing faces is inclined relative to a vertical direction so that when a vertically downwardly-directed force is exerted on said at least one combined tool block, said clamping lug is bent resiliently outward by said clamping cam so as to produce a clamping force in a horizontal direction.

2. Multi-stage forming machine according to claim 1, wherein said clamping lug is arranged in an upper edge region of said at least one of said combined tool blocks and said at least one of said combined tool blocks has another clamping lug arranged in a lower edge region of said at least one of said combined tool blocks and said body corresponding to said at least one of said combined tool blocks has another clamping cam, said another clamping lug being suspended on said another clamping cam.

3. Multi-stage forming machine according to claim 1, wherein said body corresponding to said at least one of said combined tool blocks includes an apron and said clamping cam is on said apron.

4. Multi-stage forming machine according to claim 3, further comprising a plurality of clamping lugs on said apron.

5. Multi-stage forming machine according to claim 1, wherein said at least one of said combined tool blocks includes a supporting plate and said clamping lug is on said supporting plate.

6. Multi-stage forming machine according to claims 4, comprising a plurality of clamping cams on said supporting plate.

7. Multi-stage forming machine according to claim 1, wherein a plurality of downwardly projecting clamping cams is arranged at intervals next to one another in a lower edge region of said at least one of said combined tool blocks.

8. Multi-stage forming machine according to claim 1, wherein the forming machine has at least one clamping device, for producing a clamping force acting in a vertical direction on said at least one of said combined tool blocks.

9. Multi-stage forming machine according to claim 8, wherein said clamping device is arranged underneath said at least one of said combined tool blocks and has a hydraulically actuable clamping lever.

10. Multi-stage forming machine according to claim 1, wherein the forming machine has at least one releasing device, for producing a releasing force acting in a vertical direction on said at least one of said combined tool blocks.

11. Multi-stage forming machine according to claim 10, wherein said releasing device is arranged underneath said at least one of said combined tool blocks and has a hydraulically actuable release lever.

12. Multi-stage forming machine according to claim 1, wherein said at least one of said combined tool blocks has a stop, which rests on a stopping face that is outside of said at least one of said combined tool blocks and below said stop for the accurate vertical positioning of said at least one of said combined tool blocks.

13. Multi-stage forming machine according to claim 1, wherein said at least one of said combined tool blocks has a centering element which interacts with a mating element outside of said at least one of said combined tool blocks when fitting said at least one of said combined tool blocks on said corresponding body for the horizontal centering of said at least one of said combined tool blocks on said corresponding body.

14. Multi-stage forming machine according to claim 13, wherein said centering element is a centering pin and said mating element is a centering housing.

15. Multi-stage forming machine according to claim 13, wherein said centering element is a centering housing and said mating element is a centering pin.

16. Multi-stage forming machine according to claim 1, wherein the bearing face of said clamping lug is curved.

17. Multi-stage forming machine according to claim 1, wherein said bearing face of said clamping cam is curved.

18. Multi-stage forming machine according to claim 1, wherein said clamping lug is arranged in an upper edge region of said at least one of said combined tool blocks, and said at least one of said combined tool blocks has a downwardly-projecting clamping cam arranged in a lower region of said at least one of said combined tool blocks so that said downwardly-projecting clamping cam may be pushed into an upwardly-open clamping lug.

19. Combined tool block for a multi-stage forming machine having a fixed machine body and a press slide which can be moved back and forth relative to the fixed machine body, said combined tool block comprising at least two individual tool blocks connected to a common supporting structure and a resilient clamping lug adapted to rest on a clamping cam fitted either on the machine body or on the press slide, thereby suspending said combined tool block from the clamping cam.

* * * * *